US008933360B2

(12) United States Patent
Weiden

(10) Patent No.: US 8,933,360 B2
(45) Date of Patent: Jan. 13, 2015

(54) CROWBAR DISCONNECT SWITCH

(75) Inventor: Conrad Weiden, Chapel Hill, NC (US)

(73) Assignee: Schneider Electric USA, Inc., Palatine, IL (US)

( * ) Notice: Subject to any disclaimer, the term of this patent is extended or adjusted under 35 U.S.C. 154(b) by 223 days.

(21) Appl. No.: 13/592,866

(22) Filed: Aug. 23, 2012

(65) Prior Publication Data

US 2014/0054271 A1 Feb. 27, 2014

(51) Int. Cl.
*H01H 33/02* (2006.01)

(52) U.S. Cl.
USPC ..... 218/153; 218/16; 218/140

(58) Field of Classification Search
USPC ..... 335/16, 165; 218/153, 16, 140
See application file for complete search history.

(56) References Cited

U.S. PATENT DOCUMENTS

| | | | | |
|---|---|---|---|---|
| 2,924,752 | A * | 2/1960 | Scott, Jr. | 361/12 |
| 4,949,214 | A * | 8/1990 | Spencer | 361/95 |
| 6,141,192 | A | 10/2000 | Garson | |
| 6,657,150 | B1 | 12/2003 | Shea et al. | |
| 6,724,604 | B2 | 4/2004 | Shea | |
| 7,145,757 | B2 | 12/2006 | Shea et al. | |
| 7,619,869 | B2 * | 11/2009 | Boeder et al. | 361/115 |
| 7,821,749 | B2 | 10/2010 | Asokan et al. | |
| 7,929,260 | B2 | 4/2011 | Roscoe et al. | |
| 8,400,740 | B2 * | 3/2013 | Schumacher et al. | 361/54 |
| 8,676,386 | B2 * | 3/2014 | Klodowski et al. | 700/276 |
| 2008/0007881 | A1 * | 1/2008 | Boeder et al. | 361/54 |

FOREIGN PATENT DOCUMENTS

| | | |
|---|---|---|
| DE | 234540 | 4/1986 |
| DE | 102006030671 | 1/2008 |
| EP | 1052665 | 11/2011 |

* cited by examiner

*Primary Examiner* — Truc Nguyen
(74) *Attorney, Agent, or Firm* — Locke Lord LLP

(57) ABSTRACT

A three-phase disconnect switch for a power distribution system that supplies three-phase power from a source through a main circuit breaker to multiple three-phase feeder circuits, includes three pairs of contacts adapted for connection to the three phase lines of a selected one of the feeder circuits for opening and closing each of the phase lines, and a movable actuator associated with the three pairs of contacts and responsive to a signal indicating the occurrence of an arcing fault in the selected feeder circuit for initially creating a short circuit across the three phase lines of the feeder circuit and then opening the contacts.

21 Claims, 5 Drawing Sheets

CROWBAR DISCONNECT SWITCH

FIELD OF THE INVENTION

The present invention relates generally to electrical power distribution systems and, more particularly, to protecting feeder circuits in a multi-phase power distribution system from arcing faults while also containing the arcing, dissipating the fault current to extinguish the arcing, and isolating the feeder circuit in which the fault occurred.

BACKGROUND OF THE INVENTION

Typical devices used to reduce available energy from an arc flash event, over-current event or arc fault will short out the electrical circuit while waiting for an upstream circuit to open and isolate the circuit. During this delay, considerable damage can be done by the energy being dissipated from the event that triggered the short.

When multiple feeder circuits are supplied with power from a common supply bus, circuit breakers are typically provided in each of the feeder circuits in addition to the main circuit breaker in the common supply bus. If the main circuit breaker trips before the circuit breaker of the feeder circuit in which the fault occurred, power can be unnecessarily lost in even the feeder circuits that were not affected by the fault condition.

SUMMARY OF THE INVENTION

The present invention avoids such problems by providing a three-phase disconnect switch for a power distribution system that supplies three-phase power from a source through a main circuit breaker to multiple three-phase feeder circuits. In one embodiment, the switch includes three pairs of contacts adapted for connection to the three phase lines of a selected one of the feeder circuits for opening and closing each of the phase lines, and a movable actuator associated with the three pairs of contacts and responsive to a signal indicating the occurrence of an arcing fault in the selected feeder circuit for initially creating a short circuit across the three phase lines of the feeder circuit and then opening the contacts to isolate the feeder circuit in which the fault occurred In one implementation, each feeder circuit is provided with a separate disconnect switch that responds to the detection of an arcing fault condition in that feeder circuit to instantly interrupt the supply of power to that feeder circuit while also transferring the fault current to the disconnect switch where any arcing is quickly controlled and extinguished within a protected cavity. The instant isolation of the feeder circuit in which the fault occurred reduces damage to downstream equipment, while the arc suppression protects both equipment and personnel from damage or injury that might otherwise be caused by the arcing.

One application for the disconnect switch is in a three-phase power distribution system that supplies three-phase power from a source through a main circuit breaker to multiple feeder circuits, each of which has a feeder circuit breaker downstream of the main circuit breaker, and a fault detector for producing an output signal in response to the occurrence of a fault in the corresponding feeder circuit. The normally closed contacts of the disconnect switch are located between the main circuit breaker and the feeder circuit breaker, and the actuator associated with the contacts is responsive to an output signal from the fault detector for initially shorting the three phase conductors in that feeder circuit and then opening the feeder circuit.

In one implementation, the actuator includes a plurality of spaced conductive areas for dividing arcs across the disconnect switch as the switch is opened by the actuator, thereby reducing the arc voltage until the arcs are extinguished.

BRIEF DESCRIPTION OF THE DRAWINGS

The invention may best be understood by reference to the following description taken in conjunction with the accompanying drawings, in which.

DETAILED DESCRIPTION OF THE ILLUSTRATED EMBODIMENTS

Although the present disclosure is described in connection with certain aspects and/or embodiments, it will be understood that the present disclosure is not limited to those particular aspects and/or embodiments. On the contrary, the present disclosure is intended to cover all alternatives, modifications, and equivalent arrangements as may be included within the spirit and scope of the present disclosure as defined by the appended claims.

Figure 1:
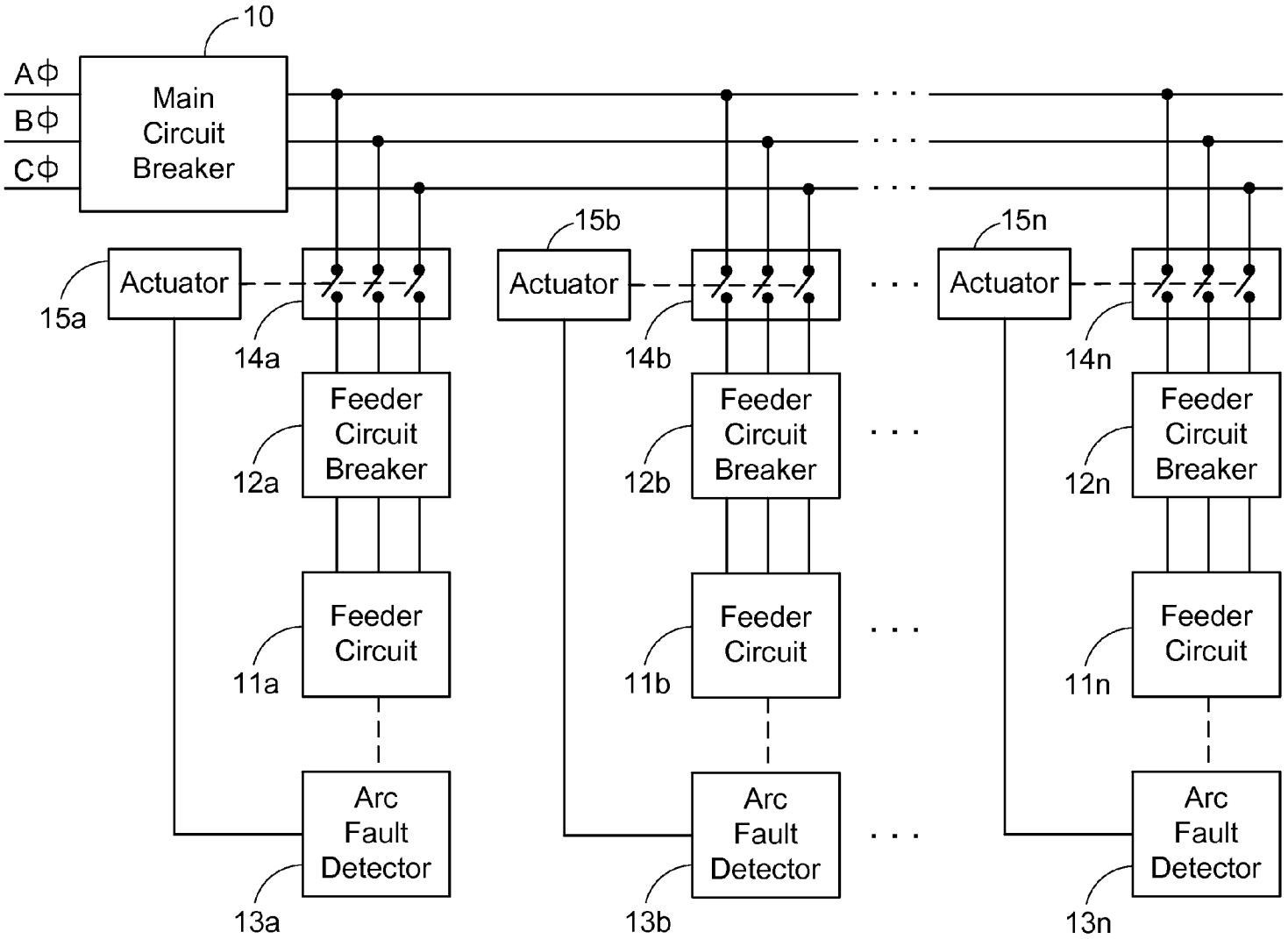
FIG. 1 is a schematic diagram of a three-phase electrical power distribution system for multiple feeder circuits supplied from a common supply bus.

Turning now to the drawings and referring first to FIG. 1, one embodiment of the invention is illustrated in the context of a three-phase power distribution system that supplies three-phase power from a source through a main circuit breaker 10 to multiple branch or "feeder" circuits 11*a*, 11*b* . . . 11*n* via respective feeder circuit breakers 12*a*, 12*b* . . . 12*n*. Each of the feeder circuits 11*a*, 11*b* . . . 11*n* is coupled to one of a set of arc fault detectors 13*a*, 13*b* . . . 13*n* that detect the occurrence of arcing faults in the respective feeder circuits 11*a*, 11*b* . . . 11*n*. As is well known, an arcing fault can cause considerable damage before the corresponding feeder circuit breaker responds by interrupting the power to the feeder circuit in which the arc occurs, and thus many different auxiliary devices have been proposed to interrupt the power to a feeder circuit immediately when an arcing fault is detected. The present invention provides an improved technique for interrupting the power to any feeder circuit immediately when an arcing fault is detected in that circuit, without interrupting the supply of power to other feeder circuits not affected by the detected arcing fault.

In the embodiment illustrated in FIG. 1, the power to any one of the feeder circuits 11*a*, 11*b* . . . 11*n* can be quickly interrupted by opening one of a set of corresponding three-phase disconnect switches 14*a*, 14*b* . . . 14*n* associated with the respective feeder circuits 11*a*, 11*b* . . . 11*n*, on the input sides of the respective feeder circuit breakers 12*a*, 12*b* . . . 12*n*. The disconnect switches 14*a*, 14*b* . . . 14*n* are controlled by respective movable actuators 15*a*, 15*b* . . . 15*n*, which receive the output signals from the respective arc fault detectors 13*a*, 13*b* . . . 13*n*. When the output signal from any given detector 13 indicates that an arc fault has been detected, the actuator 15 associated with the disconnect switch 14 for that particular feeder circuit 11 responds to that detector output signal by advancing an actuator plate 20 shown in FIGS. 2, 3 and 4.

Figure 2:
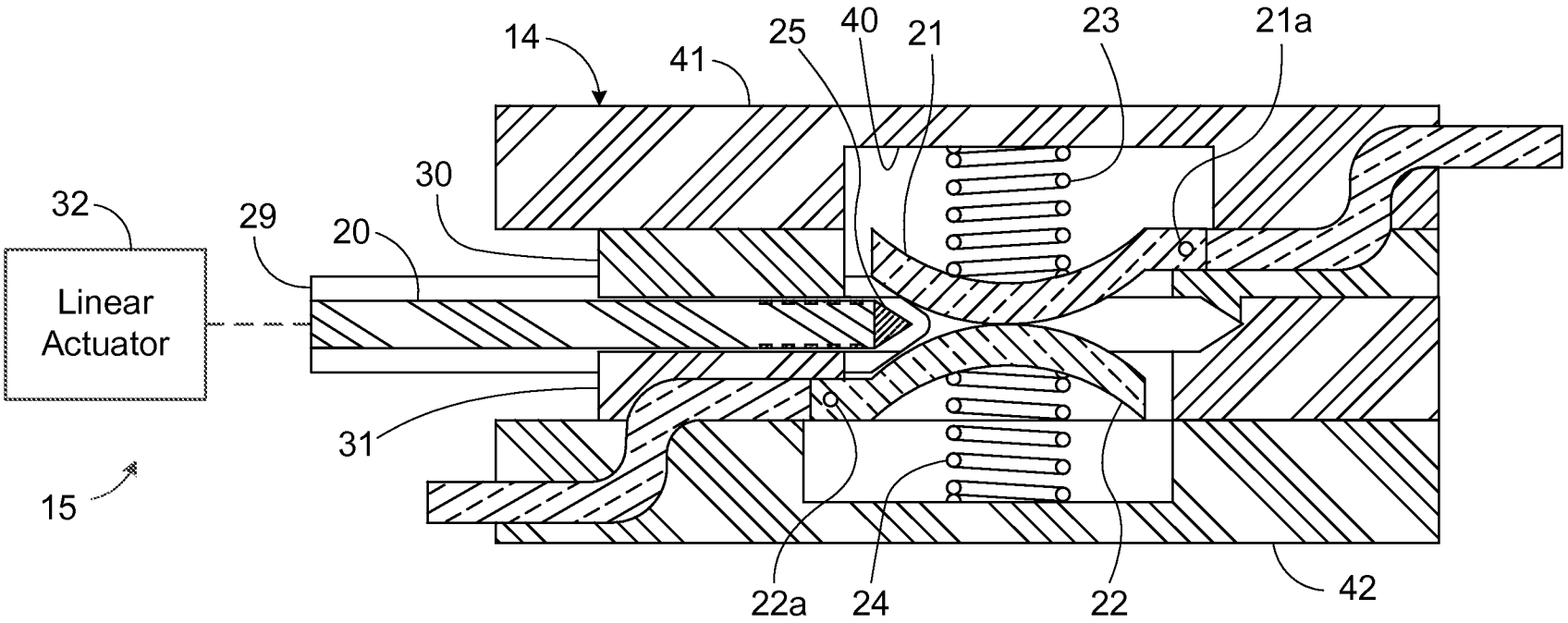
FIG. 2 is a cross section of one of the disconnect switches used in the system of FIG. 1, taken along line 2-2 in FIG. 4, with the switch contacts in their normally closed positions and with the switch actuator plate in its retracted position.
Figure 3B:
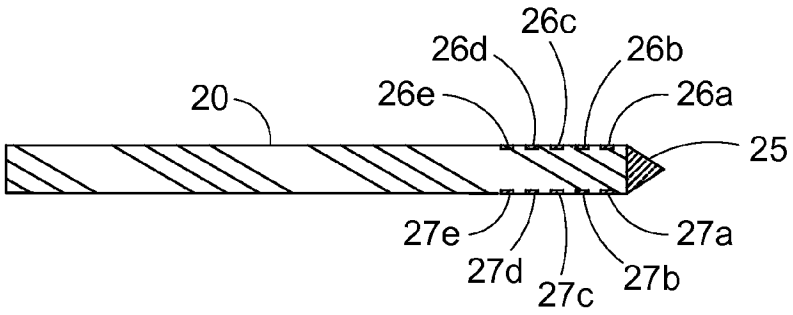
FIG. 3B is a cross-section of the actuator plate shown in FIG. 3A.
Figure 3A:
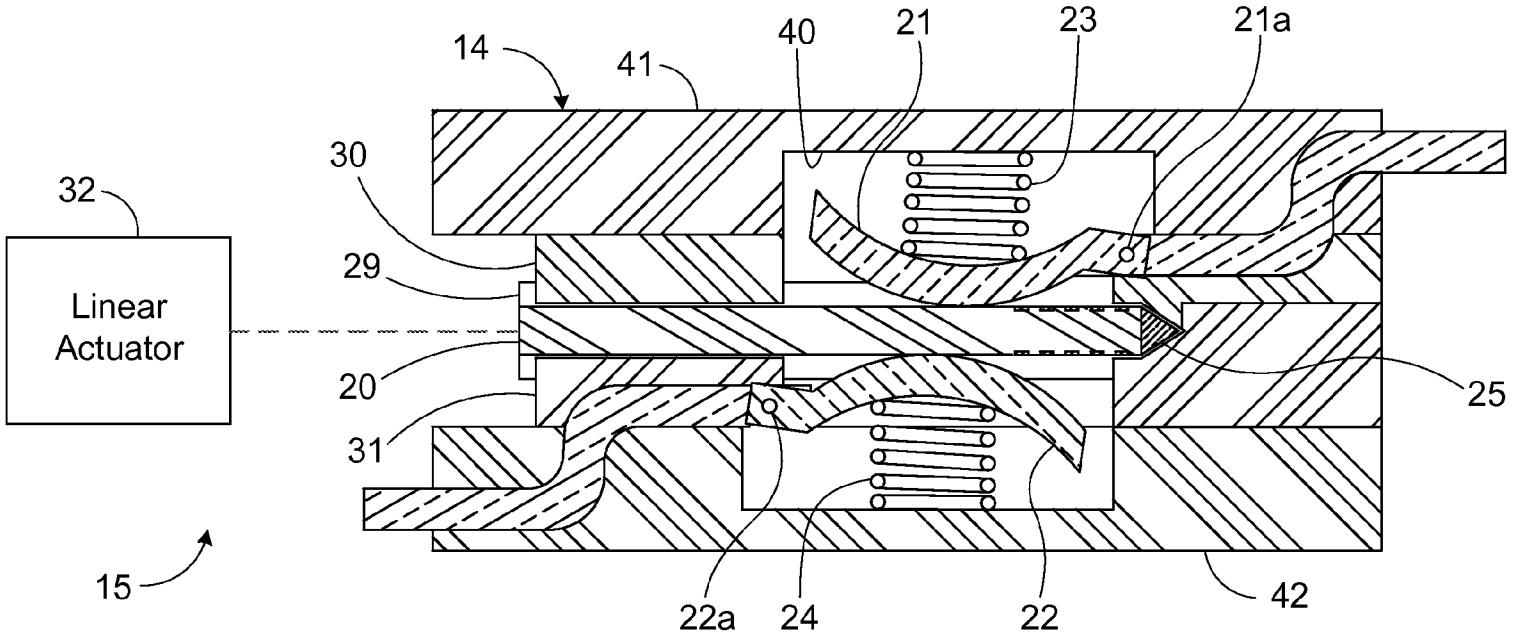
FIG. 3A is the same cross section shown in FIG. 2, but with the switch contacts in their open positions and with the switch actuator plate in its fully advanced position.
Figure 4:
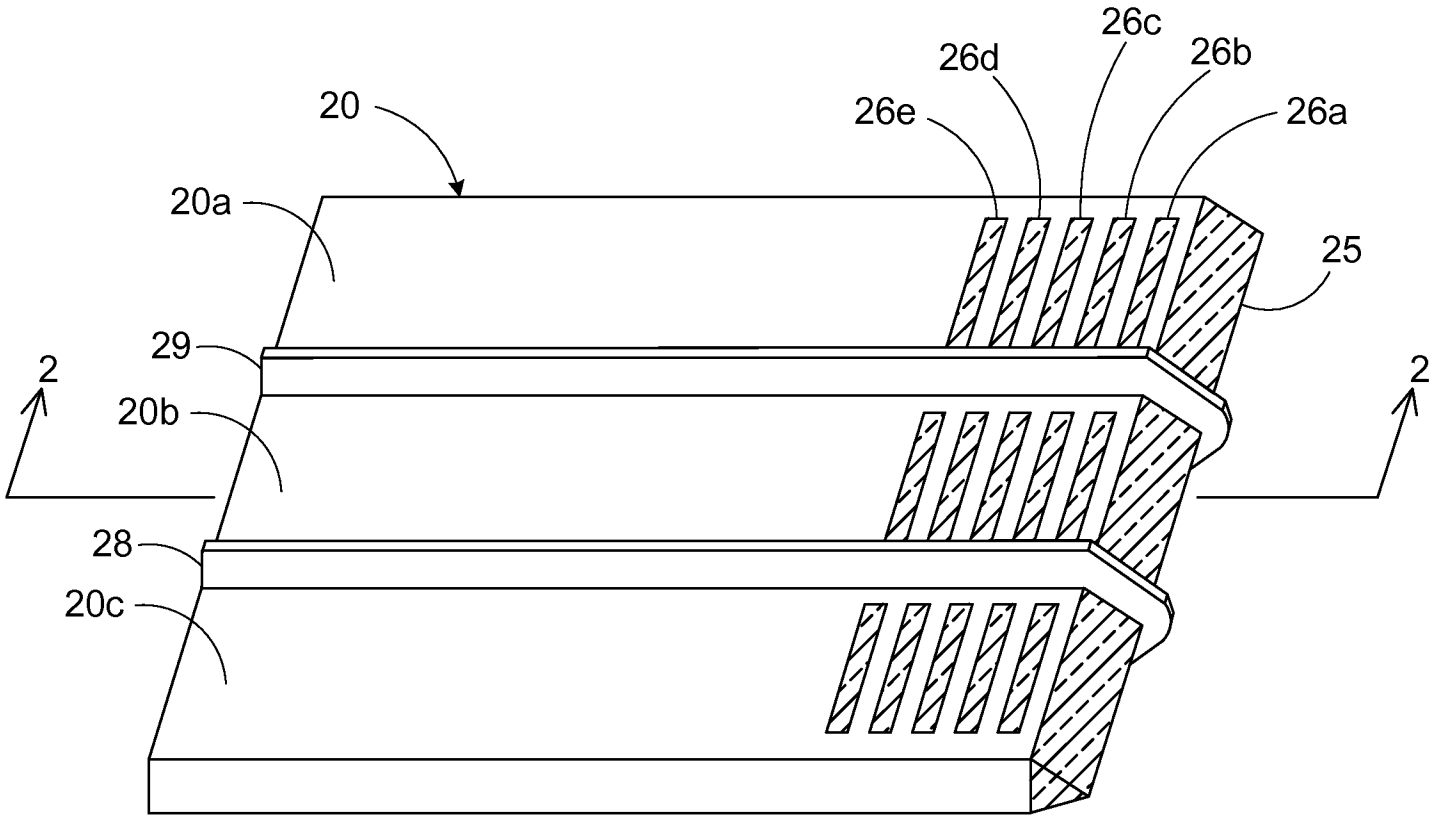
FIG. 4 is a top perspective of the actuator plate shown in FIGS. 2 and 3.

As can be seen in FIGS. 2-4, the actuator plate 20 is mounted for sliding movement relative to three pairs of pivotably mounted contacts 21 and 22 in the disconnector switch 14. Only one of the three contact pairs 21, 22 is shown in FIGS. 2 and 3, but there are two other identical contact pairs, with each pair controlling the opening and closing of one of the three lines connected to the input side of the three-phase feeder circuit breaker 14. For each pair of contacts 21 and 22, two biasing springs 23 and 24 urge the contacts 21 and 22 against each other, so that the disconnect switch is normally closed for all three lines. To permit movement of both contacts toward and away from each other, the contacts 21 and 22 are pivotably mounted on respective pins 21*a* and 22*a*

In FIG. 2, the actuator plate 20 is in its normal retracted position, with the springs 23 and 24 in each of the three pairs of contacts 21, 22 holding each pair of contacts in their normally closed condition. When the corresponding arc fault detector 13 produces an output signal indicating that an arc fault has been detected in that particular feeder circuit 11, the actuator plate 20 is instantly advanced to the position shown in FIG. 3 by a conventional linear drive device (not shown). As the actuator plate 20 engages and then moves between the three pairs of contacts 21, 22, the three pairs of contacts are simultaneously opened, thereby opening that feeder circuit. In its fully advanced advanced position, the actuator plate 20 holds all three pairs of contacts 21, 22 spaced apart from each other, which is the open condition of the disconnect switch 14. This open condition is attained before the slower-acting main circuit breaker 10 opens, thereby opening and isolating the circuit in which the fault occurred (isolating the load from the line side connections) while avoiding interruption of the power supplied to all the feeder circuits 11 that are not affected by the arc fault.

To permit movement of the actuator plate 20 between its retracted and advanced positions, the plate 20 is slidably mounted between two dielectric guide plates 30 and 31. Movement of the actuator plate 20 is effected by a linear electrical actuator 32 attached to the outboard end of the plate 20, so that advancing and retracting movement of the plate 20 may be controlled by electrical signals that control the energization and de-energization of the linear actuator 32. Such actuators are commercially available, such as the "Quickshaft" linear DC servomotors available from Dr. Fritz Faulhaber GMBH & Co.

The contacts 21 and 22 are both curved away from each other on both sides of the point where they contact each other when the switch is closed. This creates a tapered entry for the front edge of the actuator plate 20 as it is advanced between the two contacts. The leading edge portion 25 of the actuator plate 20 is wedge-shaped, and the tapered surfaces of the wedge engage the curved contacts 21, 22 and cam them away from each other, against the forces of the biasing springs 23, 24. In the fully advanced position, depicted in FIG. 3, the leading edge portion 25 of the actuator plate 20 fits into a complementary recess formed in the wall of the switch cavity.

As depicted in FIG. 4, each of the three pairs of contacts 21, 22 is engaged by one of three segments 20*a*, 20*b* and 20*c* of the single actuator plate 20. The main body of the plate 20 is made of a non-conductive dielectric material, but the wedge-shaped leading edge portion 25 is made of a conductive metallic material, in the form of a single, unitary wedge-shaped bar that extends along the front ends of all three segments 20*a*, 20*b* and 20*c*. Consequently, when the front edge portion 25 simultaneously engages the three pairs of contacts 21, 22, it momentarily forms a short circuit across the three lines that form the three-phase power input bus for the feeder circuit in which the arc fault was detected. The front edge portion 25 thus functions as a "crowbar" that transfers the fault current from the detected arc fault to the short circuit formed by the disconnect switch.

As the actuator plate 20 continues to advance between the three pairs of opened contacts 21, 22, the leading edge portion 25 of the plate 20 plate becomes disengaged from all the contacts, thereby breaking the momentary short circuit across the three phase lines. At this point the fault current produces arcs between the crowbar front edge of the plate 20 and the movable contacts 21, 22. As the plate continues to advance, the arcs across any given pair of opened contacts 21, 22 are attracted to two sets of conductive arc plates 26*a*-26*e* and 27*a*-27*e* on the top and bottom surfaces of the actuator plate 20, as those arc plates sequentially pass between the three pairs of contacts 21, 22. Specifically, three identical sets of arc plates 26*a*-26*e* are formed on the top surface of the actuator plate 20, and three identical sets of arc plates 27*a*-27*e* are formed on the bottom surface of the actuator plate 20. Dielectric partitions 28 and 29 separate adjacent sets of the arc plates 26*a*-26*e* from each other on the upper surface of the plate 20, and those partitions wrap around the leading edge of the plate 20 and continue along the lower surface of the plate 20 to separate adjacent sets of the arc plates 27*a*-27*e* from each other on the lower surface. Because the arcs from any given pair of contacts 21, 22 are attracted to all the arc plates on the corresponding segment of the actuator plate 20, the spaced arc plates progressively divide the arcs and thereby reduce the arc voltage until the arcs become extinguished. This occurs so quickly that the arcs are extinguished before the main circuit breaker 10 can trip, so there is no interruption of the power being supplied to the various feeder circuits not affected by the arc fault.

Because of the curvature of the contacts 21, 22 in each of the three pairs, the spaces between the contacts and each successive arc plate progressively diminish as the actuator plate 20 advances between the three pairs of contacts. Thus the lengths of the arc segments attracted to successive arc plates are gradually reduced until those segments are extinguished as the arc plates successively engage the adjacent contact.

To contain the arcing that occurs within the disconnect switch 14, the contacts 21, 22 and the portion of the actuator plate 20 that interacts with those contacts are contained within a cavity 40 formed by a dielectric housing having upper and lower sections 41 and 42 laminated against the two guide plates 30 and 31. Thus, the energy of the current transferred from the arc fault to the disconnect switch is contained and dissipated within the cavity 40, so that it cannot do any damage.

Although the illustrative embodiment of the invention described above utilizes arc fault detectors to detect occurrences of arc faults in the feeder circuits, the disconnect switches could respond to signals produced in response to over-current events. It will also be understood that the disconnect switches may be either resettable switches or switches that require servicing after each occurrence of a fault that causes the actuation of one of the disconnect switches.

Figure 5:
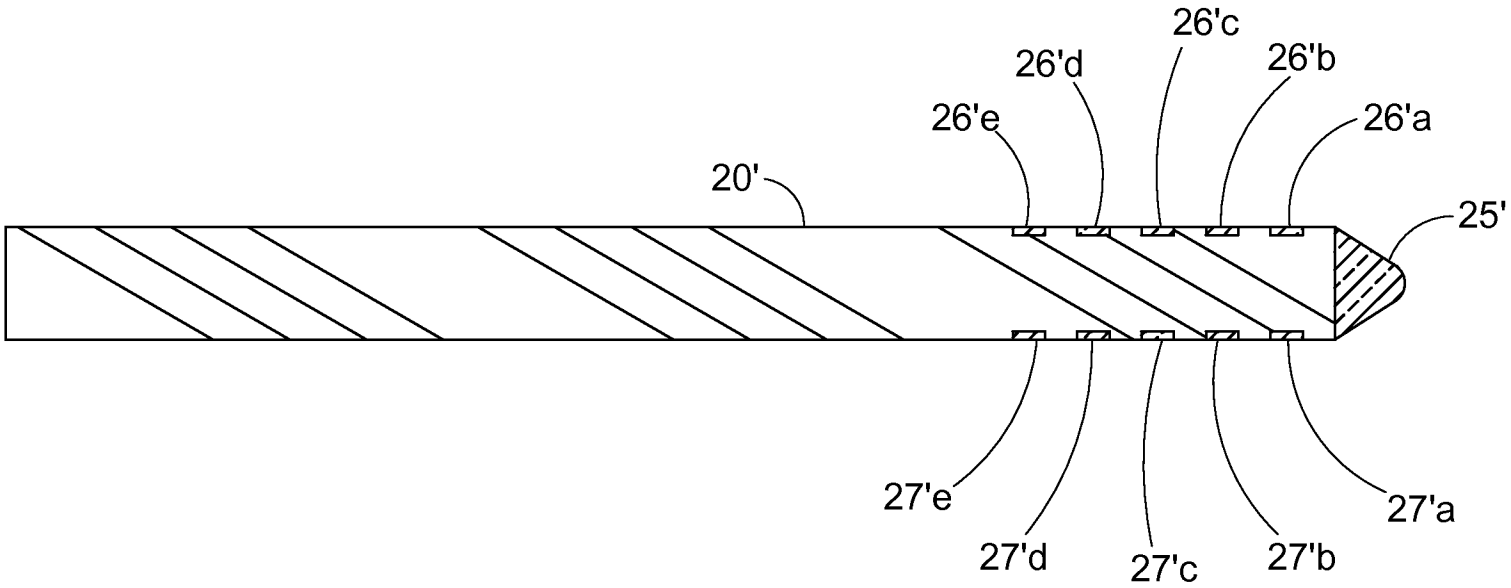
FIG. 5 is a cross-section of a modified actuator plate for use in the disconnect switch of FIG. 2.

FIG. 5 illustrates a modified actuator plate 20' having a conductive leading edge portion 25' that has a blunt or rounded front tip. This configuration permits the front tip of the plate 20' to be located closer to the contacts 21, 22 when the plate 20' is in its retracted position (by simply reducing the profiles of the adjacent portions of the partitions 28 and 29), thereby reducing the time required for the disconnect switch to open the contacts. The rounded tip also improves the dielectric properties of the actuator plate 20'.

While particular aspects, embodiments, and applications of the present disclosure have been illustrated and described, it is to be understood that the present disclosure is not limited to the precise construction and compositions disclosed herein and that various modifications, changes, and variations may be apparent from the foregoing descriptions without departing from the spirit and scope of the present disclosure as defined in the appended claims.

What is claimed is:

1. A three-phase disconnect switch for a power distribution system that supplies three-phase power from a source through a main circuit breaker to multiple three-phase feeder circuits, said switch comprising three pairs of contacts adapted for connection to the three phase lines of a selected one of said feeder circuits for opening and closing each of said phase lines, and a movable actuator associated with said three pairs of contacts and responsive to a signal indicating the occurrence of an arcing fault in said selected feeder circuit for initially creating a short circuit across the three phase lines of said feeder circuit and then opening said contacts.

2. The three-phase disconnect switch of claim 1 in which said actuator is adapted to dissipate and extinguish arcing across said contacts when said contacts are opened.

3. The three-phase disconnect switch of claim 2 in which said actuator comprises a dielectric material having a plurality of conductive areas spaced along the direction of movement of said actuator for dividing an arc across said contacts as said contacts are opened by said actuator.

4. The three-phase disconnect switch of claim 1 which includes a dielectric housing forming a cavity in which said contacts are located.

5. The three-phase disconnect switch of claim 4 in which said actuator simultaneously engages all of said contacts to form a short circuit across the three phase lines of said selected feeder circuit, and then simultaneously opens all of said contacts.

6. The three-phase disconnect switch of claim 5 in which said actuator is a slidable plate having a front end portion of a conductive material that simultaneously engages all of said three pairs of contacts to form a short circuit across the three phase lines in said selected feeder circuit, and then simultaneously opens all of said contacts.

7. The three-phase disconnect switch of claim 6 in which said slidable plate has multiple conductive areas on opposite surfaces thereof, with the conductive areas on each surface being spaced along the direction of movement of said actuator for dividing arcs from said contacts as said contacts are opened by said actuator.

8. The three-phase disconnect switch of claim 1 in which at least one contact in each pair is mounted for movement into and out of engagement with the other contact in that pair, and which includes biasing elements urging said movable contact in each pair toward the other contact in that pair.

9. A three-phase power distribution system for supplying three-phase power from a source through a main circuit breaker to multiple three-phase feeder circuits, each of said feeder circuits having a feeder circuit breaker downstream of said main circuit breaker, an arcing fault detector for producing an output signal in response to the occurrence of an arcing fault in the corresponding feeder circuit, a normally closed three-phase disconnect switch on the input side of said feeder circuit breaker, and a movable actuator associated with said disconnect switch and responsive to an output signal from said arcing fault detector for initially creating a short circuit across the conductors in that feeder circuit and then opening said feeder circuit.

10. The three-phase power distribution system of claim 9 in which said actuator is adapted to dissipate and extinguish arcing across said disconnect switch when that switch is opened.

11. The three-phase power distribution system of claim 10 in which said actuator comprises a dielectric material having a plurality of conductive areas spaced along the direction of movement of said actuator for dividing an arc across said disconnect switch as said switch is opened by said actuator.

12. The three-phase power distribution system of claim 9 in which said disconnect switch comprises multiple pairs of contacts for opening and closing each of the three-phase lines of said feeder circuit.

13. The three-phase power distribution system of claim 12 which includes a dielectric housing forming a cavity in which said multiple pairs of contacts are located.

14. The three-phase power distribution system of claim 12 in which said actuator simultaneously engages all of said contacts to form a short circuit across said three-phase lines, and then simultaneously opens all of said contacts.

15. The three-phase power distribution system of claim 14 in which said actuator is a slidable plate having a front end portion of a conductive material that simultaneously engages all of said multiple pairs of contacts to form a short circuit across said three-phase lines in any feeder circuit in which said fault was detected, and then simultaneously opens all of said contacts.

16. The three-phase power distribution system of claim 15 in which said slidable plate has multiple sets of conductive areas on at least one surface thereof, with the conductive areas in each set being spaced along the direction of movement of said actuator for dividing arcs from said contacts as said switch is opened by said actuator.

17. The three-phase power distribution system of claim 9 in which said disconnect switch comprises multiple pairs of contacts for opening and closing the multiple lines of said three-phase feeder circuit, at least one contact in each pair being mounted for movement into and out of engagement with the other contact in that pair, and biasing elements urging said movable contact in each pair toward the other contact in that pair.

18. A method of supplying three-phase power from a source through a main circuit breaker to multiple three-phase feeder circuits downstream of said main circuit breaker, each feeder circuit having a feeder circuit breaker, said method comprising detecting arcing faults in said feeder circuits and producing an output signal in response to the occurrence of an arcing fault in any of said feeder circuits, and in response to said output signal, initially creating a short circuit across the conductors in any feeder circuit upstream of a respective feeder circuit breaker in which said arcing fault was detected and then opening any such feeder circuit upstream of the respective feeder circuit breaker.

19. The method of claim 18 in which said short circuit across the conductors in any feeder circuit in which said arcing fault was detected is effected by momentarily crowbarring the multiple lines of any such feeder circuit, and then interrupting of the supply of power to any such feeder circuit is effected by opening said multiple lines of any such feeder circuit.

20. The method of claim 18 which includes dividing arcs across said disconnect switch when that switch is opened, thereby reducing the arc voltage until the arcs are extinguished.

21. The method of claim 18 which includes forming a short circuit across said three-phase lines in any feeder circuit in which a fault was detected, and then opening those three phase lines to interrupt the supply of power to such feeder circuit.

* * * * *